US005346310A

United States Patent [19]

Nguyen

[11] Patent Number: 5,346,310

[45] Date of Patent: Sep. 13, 1994

[54] THERMOPLASTIC BAG SYSTEM

[75] Inventor: Tai H. Nguyen, Kenner, La.

[73] Assignee: Advance Poly Bag, Inc., Metairie, La.

[21] Appl. No.: 164,264

[22] Filed: Dec. 9, 1993

Related U.S. Application Data

[63] Continuation-in-part of Ser. No. 2,196, Jan. 8, 1993, Pat. No. 5,269,605.

[51] Int. Cl.[5] ..... B65D 1/34

[52] U.S. Cl. ..... 383/9; 206/554

[58] Field of Search ..... 206/554; 383/9

[56] References Cited

U.S. PATENT DOCUMENTS 4,676,378 6/1987 Baxley et al. ..... 383/9
4,883,450 11/1989 Benoit ..... 383/9
5,074,674 12/1991 Kukligs et al. ..... 383/9

*Primary Examiner*—Joseph Man-Fu Moy
*Attorney, Agent, or Firm*—Joseph T. Regard

[57] ABSTRACT

A bag and system for dispensing configured to minimize the probability of stress fractures in the dispensed bag, and tearing associated therewith, while providing a system which leaves no "throw away" product on the rack after dispensing a bag stack, as the present system has no central tear-off tab. The present system teaches the utilization of reinforced, radially configured handle support slits to provide an opening for allowing the passage of a horizontal handle support member therethrough, the support slits further configured to provide maximum opening of the bag mouth for easier loading, and easier placement of the bag pack upon the rack. Unlike prior art systems, the radial slit of the present invention is configured to easily spread apart to receive the handle support member, without tabs or folds formed therein. Further, the bag of the present invention also contemplates a uniquely configured, non-removable central mouth support piece, wherein there is provided a distally situated, curved support slit configured for accepting a rack central support piece, the slit configured for providing maximum ease in separation of the dispensed bag from the pack, with nominal crimping of the slit edges during loading of the pack, or tearing of the bag upon dispensing.

3 Claims, 5 Drawing Sheets

THERMOPLASTIC BAG SYSTEM

STATEMENT OF CONTINUING APPLICATION

The present invention is a continuation in part of U.S. Pat. No. 5,269,605, filed Jan. 8, 1993, and issued Dec. 14, 1993, entitled "Thermoplastic System", naming inventor Tai H. Nguyen. Bag

BACKGROUND OF THE INVENTION

1. Invention Field

The present invention relates to bag dispensing systems, and particularly to a bag and system for dispensing thermoplastic bags or the like from a stack of bags. The present system is configured such that it may be utilized with a variety of off-the-shelf rack configurations, and to provide optimal characteristics for dispensing bags one at a time, while further providing a system wherein the bag to be dispensed may be retained in an open position, to allow for the loading thereof with contents for carrying, such as purchased goods or the like.

The preferred, exemplary embodiment of the present system teaches a configuration which minimizes the probability of stress fractures in the dispensed bag, and tearing associated therewith, while providing a system which leaves no "throw away" product on the rack after dispensing a bag stack, as the present system has no central tear-off tab, thereby providing a more environmentally attractive alternative to other, prior art systems.

Further, the present system teaches the utilization of reinforced, radially configured handle support slits to provide an opening for allowing the passage of a horizontal handle support member therethrough, the support slits further configured to provide a medial curved area situated to allow the outer edge of the slit to "ride" upon the handle support member, allowing maximum opening of the bag mouth for easier loading, and easier placement of the bag pack upon the rack.

Unlike prior art systems, the radial slit of the present invention is configured to easily spread apart to receive the handle support member, without tabs or folds formed therein.

Further, the bag of the present invention also contemplates a unique, non-removable central mouth support piece, wherein there is provided a curved support slit configured for accepting a rack central support piece, the slit configured to provide maximum ease in separation of the dispensed bag from the pack, with nominal crimping of the slit edges during loading of the pack, or associated tearing of the bag upon dispensing.

2. General Background Discussion

Although thermoplastic grocery bags have been utilized for over twenty years, only a very small percentage of the hundreds of patents have been embraced by industry to the point of significant commercial acceptance. Designing a thermoplastic bag, particularly with regard low or high density thermoplastic bags, can be a tedious and often unfruitful endeavor, as such material requires a design which allows its utilization as a bag for often heavy contents, which can cause stress fractures and bag failure. Further, the design should be able to be manufactured in an inexpensive, efficient, and consistent manner.

A list of prior patents which may be of interest is presented below

| Patent No. | Inventor(s) | Issue Date |
|---|---|---|
| RE 33,264 | Baxley et al | 06/17/1990 |
| 4,476,979 | Reimann et al | 10/16/1984 |
| 4,785,938 | Benoit, Jr. et al | 11/22/1988 |
| 4,811,417 | Prince et al | 03/07/1989 |
| 4,989,732 | Smith | 02/05/1991 |

U.S. Pat. No. Re. 33,264 teaches a system wherein there is required a flap in a handle aperture, as well as a detachable tab. It is asserted that the handle aperture/-flap arrangement, when installing a stack of bags on a rack, may unnecessarily complicate the process, as it requires the positioning of the handle members directly in line with the aligned handle apertures to allow passage of the support member and flap therethrough. Further, the detachable tab unnecessarily requires the additional task of disposing the remaining pieces from the dispensed pack.

U.S. Pat. Nos. 4,811,417 and 4,989,732 teach the utilization of a straight, longitudinally situated slit in the handle aperture for engaging the handle support member of the rack. These systems too may have problems, as with low or high density bags, the slits may tear in longitudinal fashion when loaded fully, causing the bag to fail.

SUMMARY DISCUSSION OF THE INVENTION

Unlike the prior art, the present invention provides a bag dispenser system which is comparatively strong and reliable, while being inexpensive to manufacture, requiring little in the way of custom manufacturing equipment, while being consistent in performance and quality.

The present invention as configured teaches two types of improvements over prior art systems, namely, relative the central mouth and handle support methods, and apparatus for achieving same.

The present invention, unlike much of the prior art, teaches neither the utilization of a straight, longitudinal line, nor an aperture having a flap ('264), rather, the present invention contemplates a radially curved slit configured to spread rather fold upon installation about a rack handle support members; this design provides superior ease in installation when compared to the aperture/flap arrangement, coupled with superior strength over the longitudinal slit arrangement.

Unlike the longitudinal slit, any tear which might occur with regard to the curved slit will occur in the direction of the end lines, that is, laterally, straight to the edge of the outer handle wall, where tearage will cease, as opposed to the longitudinal direction, which could separate the handle upwards, causing roping and failure, or downwards to the body of the bag, causing it to rupture.

In the present invention, in order to maintain the curved handle slit in a spread fashion about the support rod, a bridge area may be provided, strengthening the edges of the medial area, and allowing trouble-free installation of the slit about the handle support member.

The bag of the present invention also contemplates a unique, non-removable central mouth support piece, wherein there is provided an curved support slit configured for accepting a rack central support piece, the slit configured for providing maximum ease in separation of the dispensed bag from the pack, with nominal crimping of the slit edges during loading of the pack, or tearing of the bag upon dispensing.

It is therefore an object of the present invention to provide an improved system for dispensing individual thermoplastic bags or the like.

It is another object of the present invention to provide a radial handle support slit configuration which spreads to allow the passage of a rack handle support member, supporting said handle on the outer edge of said slit.

It is another object of the present invention to provide a non-detachable tab having a support slit configured for accepting the rack support piece in such a fashion as to prevent crimping or folding.

It is still another object of the present invention to provide a bag dispensing system which requires little significant equipment modification, while providing a consistent quality, strong and aesthetically acceptable product.

Lastly, it is an object of the present invention to provide a bag pack which is easily loaded upon a rack, and once dispensed, leaves no residual tabs or pieces thereon.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and wherein.

DETAILED DESCRIPTION OF THE INVENTION

Figure 1:
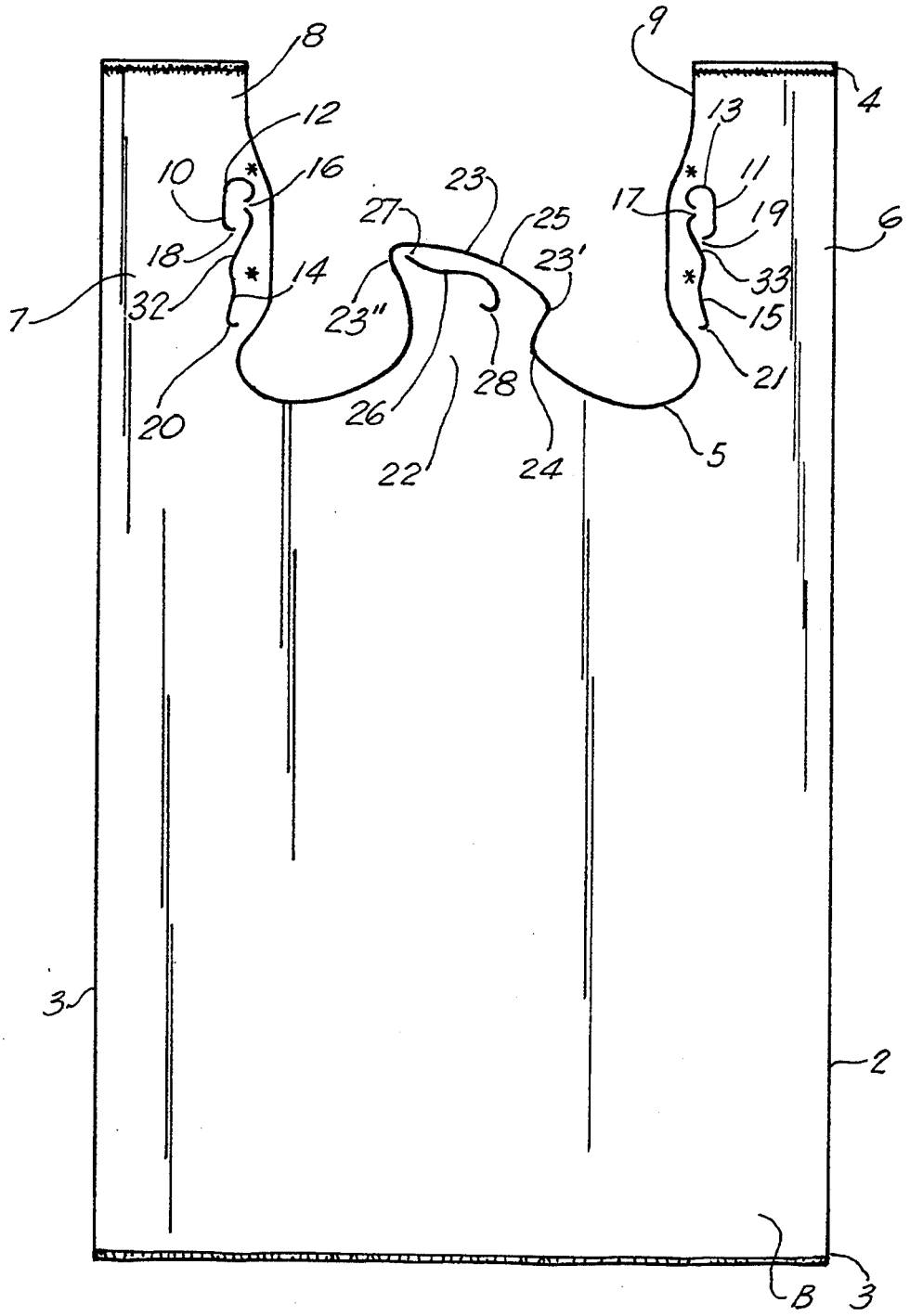
FIG. 1 is a frontal view of the bag and bag of the preferred, exemplary embodiment of the present invention, illustrating the curved handle slit configuration, as well as the angled tab support slit.

As can be seen in FIG. 1, the bag B of the preferred, exemplary embodiment of the present invention, includes first 1 and second 2 sides, a bottom 3 and top 4 ends, and a mouth 5. Emanating from opposing ends of the mouth 5 are first 7 and second 6 handles, each having an inner side edge 8, 9, respectively. Further included in the handles 7, 6, are first and second handle support slits 10, 11, respectively. Each handle support slit 10, 11, as shown, respectively includes an upper section 12, 13, a lower section 14, 15, and a medial area 32, 33 therebetween. The handle support slits may be formed via cutting die or the like pressed upon and through the bag.

As further shown in FIG. 1, the handle support slits 10, 11 of the preferred, exemplary embodiment of the present invention respectively includes a bridge piece 16, 17 comprising an uncut portion of the bag transversing the slit between the medial area 32, 33, and the upper section 12, 13, although said bridge piece may alternatively be located between the medial area 32, 33 and the lower section 14, 15 of the support slits 10, 11, respectively.

Support slits 10, 11 further include upper 18, 19 and lower 20, 21 ends, respectively. In the preferred embodiment of the present invention, both the upper 18, 19 and lower 20, 21 ends of the bag are configured so as to end in general lateral configuration relative the longitudinal axis of the bags, the ends 18, 20, and 19, 21 configured to discontinue pointing generally in the direction of the inner side edges 8, 9 of their respective handles 7, 6, respectively.

Emanating from the bag mouth 5 is tab 22, having a neck 24, and an upper, bulbous portion 23 having a sloping top edge 25 forming an upper edge 23'' and a lower edge 23'. Formed and situated at an angled, lateral position relative the upper edge 23'' of the bulbous portion 23 of tab 22 is the tab support slit 26 having first 27 and second 28 ends.

Figure 2:
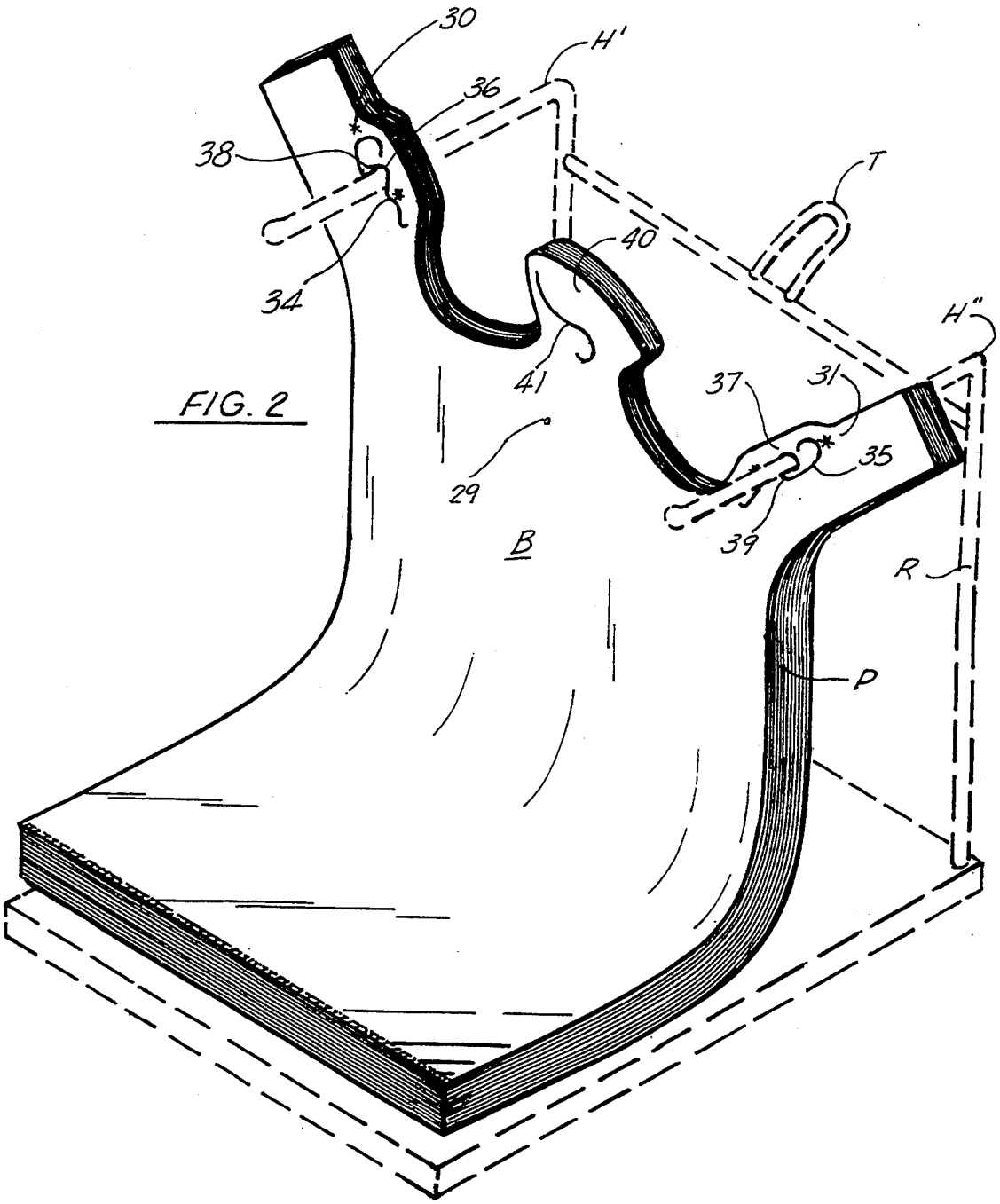
FIG. 2 is an isometric view of the bag pack of FIG. 1, as it is placed upon an exemplary rack, illustrating the communication of the support slits with the various rack support members.

Referring to FIG. 2 of the drawings, the individual bags B of the present invention are held together in a bag pack P via the utilization of a heated or cold punch 29 formed near the tab 40, and punches 30, 31 formed in the handles, in the preferred embodiment, juxtaposed the upper end of the handles and slits 34, 35, respectively.

As further shown, the bag pack of the present invention may be dispensed upon a rack R having first and second, somewhat horizontally situated handle support members H', H'', and a tab 40 support member T, configured to communicate with handle support slits 34, 35 and tab slit 41, respectively.

The preferred embodiment of the present invention teaches the forming of a medial section 36, 37 in the handle support slits 34, 35, configured to spread to allow the passage of handle support member H', H'' therethrough. Bridge 38, 39, may also be formed above the medial sections 36, 37, to facilitate separation of the slits 34, 35.

Figure 3A:
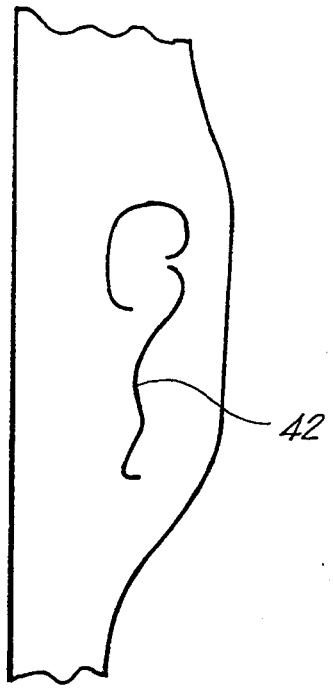
FIG. 3A is a side, close up view of the handle support slits of the bag pack of FIG. 1.
Figure 3B:
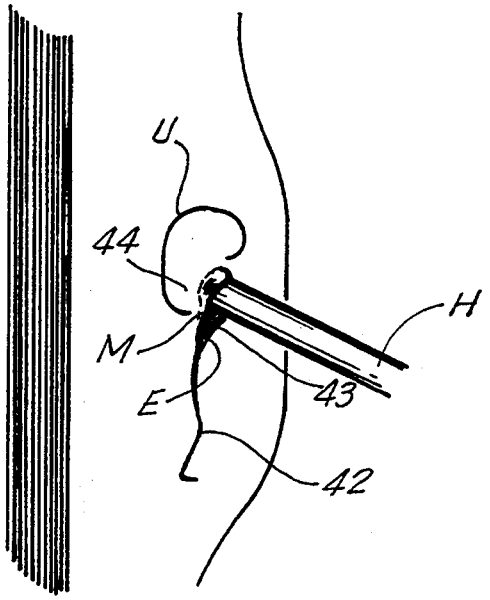
FIG. 3B is a side, close up view of the bag pack of FIG. 3A, illustrating the communication of the horizontal support bar with the outer, medial edge of the handle support slit, to hold the handles spread apart in a fashion which would not tear said handles, allowing maximum opening of the bag mouth during loading.

FIG. 3A illustrates a close-up view of an exemplary handle support slit 42, while FIG. 3B illustrates said slit 42, wherein the slit is spread to form an opening 43 sufficient to allow passage of handle support member H therethrough. Note the slit bridge 44 rides along the top of the handle support member H, assisting the member H in maintaining its position along the medial M section of the slit 42. The bridge 44 also allows the flexing of the upper U and medial M portions of the slit, allowing spreading of the slit 42 to form the desired opening, while maintaining the integrity of the opening 43 formed, allowing the slit edges to uniformly communicate with the handle H and preventing the folding of the edge E walls as the handle support member H is passed through the opening 43.

Figure 4:
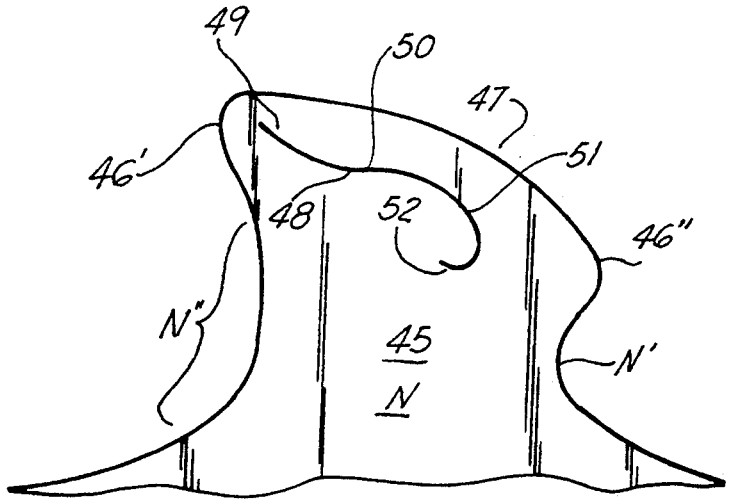
FIG. 4 is an upper, close up view of the angled support slit of the central support piece of the present invention.

FIG. 4 illustrates the tab 45 of the preferred embodiment of the present invention, the tab including a first, short neck N' edge, and a second longer neck N'' edge forming the neck N, terminating in the form of bulbous tab extensions 46', 46'' extending out from the neck area N. Tab 45 further includes an upper, curved, top edge 47 sloping from first tab extension 46' to the second tab extension 46''.

As further illustrated, tab 45 further includes tab slit 48 having first 49 and second 52 ends and a medial area therebetween, the first end 49 formed near the first bulbous tab extension 46', and running generally toward the first, short neck N' edge, then generally leveling horizontally 50 in the medial area of said slit, then running downward 51 and curving back towards generally the first bulbous tab extension 46' before terminating in end 52.

Figure 5:
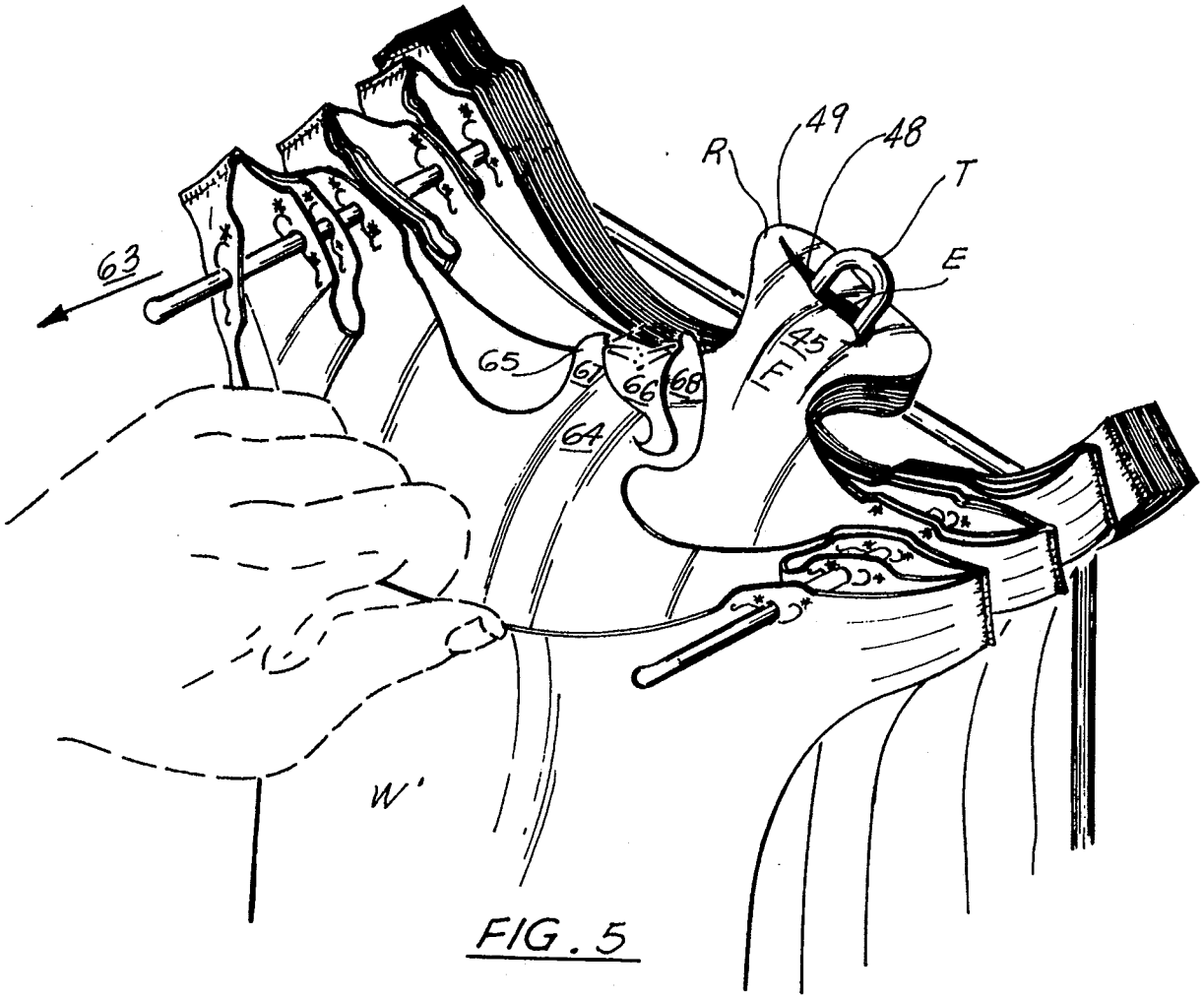
FIG. 5 is an upper, frontal view of the invention of FIG. 1, illustrating removal of the first wall of the central support piece of the first bag of the pack of the present invention, partially dispensing a bag and placing it into the loading position.

As further illustrated in FIG. 5, the tab 45 should be slipped over tab support member T via the opening formed by spreading slit 48, such that tabs of the bags forming the pack are stacked, with the upper edge E of slit 48 in communication with the tab support member T. The angled slit of the tab, as shown in FIG. 4, assists in facilitating this proper positioning with little effort by the user. Referring again to FIG. 5, in dispensing the bag, the user merely applies light pressure to the face F of the tab and pulling towards him, the user is able to release that tab, the slit 48 rupturing at its higher, first end, tearing to the outer edge of the tab at rupture zone R, releasing the tab and first bag wall from the rack, while retaining the second bag wall for allowing the opening and loading the bag.

Upon loading of the bag, the first wall W' is grasped and pulled to remove the loaded bag from the rack. As further shown in FIG. 5, once the first wall W' is removed and the bag continues to be pulled toward 63 the user, the tab 64, still engaged to the tab support member T, ruptures 66 at the first end 65 of the slit causing the higher, first end of the tab 68 to separate from the lower end 67 on the ruptured side, and allowing the upper end to slip around and away from the tab support member T, and off the rack, thereby completing the dispensing operation.

Figure 6:
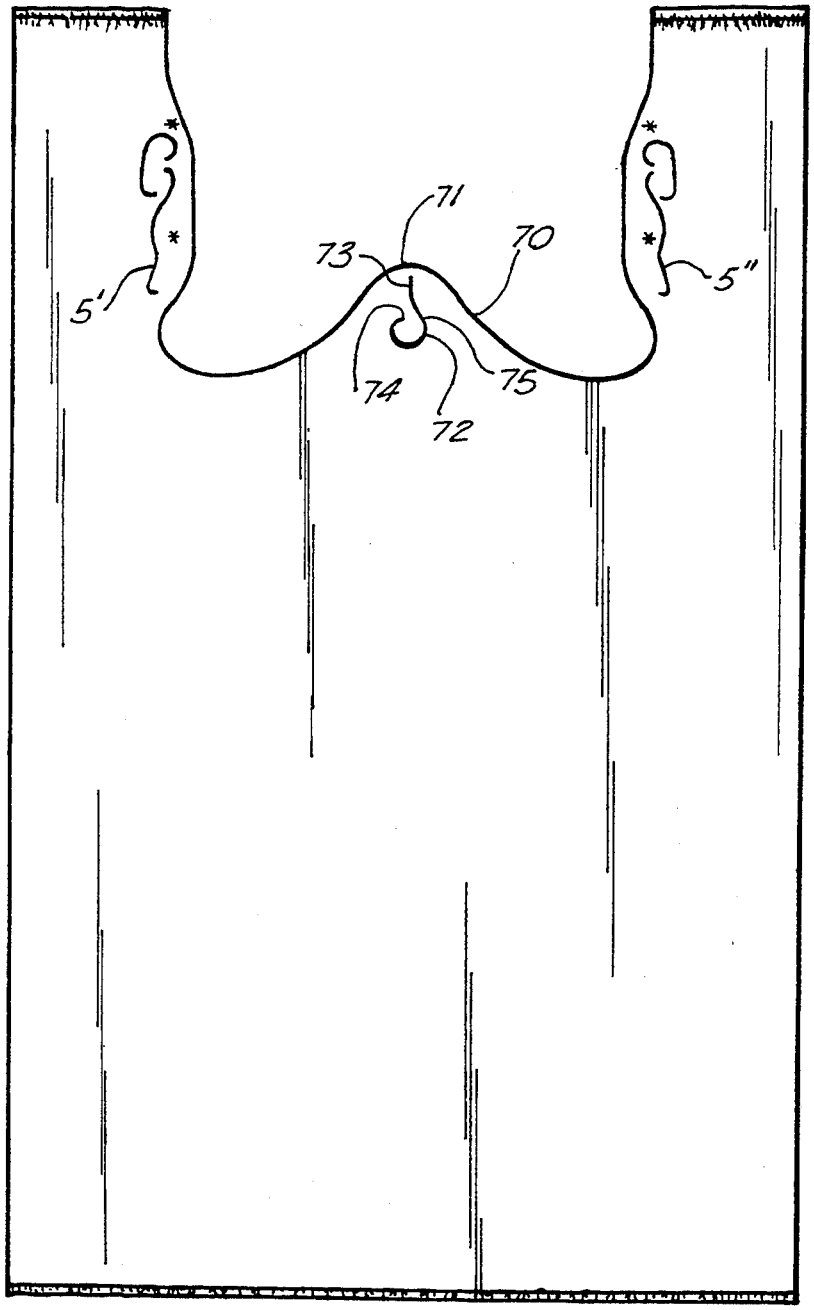
FIG. 6 is a frontal view of an alternative embodiment of FIG. 1, illustrating an alternative, curved central tab support slit.

FIG. 6 discloses an alternative embodiment of the present invention, wherein there is provided an alternative tab design, wherein the tab 70 comprises an evenly sloped extension emanating from the medial area of the mouth of the bag, the upper edge portion 71 of the tab is generally aligned with the lower portion of the handle slits S', S''. Situated within the extension forming the tab 70 is a slit 72, having a first, upper end 73 situated about 1/32–1/3 inch from the upper edge of the tab, running down longitudinally aligned with the axis of the bag and in general lateral relation to the bag mouth to a medial area 75, then curving to a second, lower end 74, said end directed generally towards said medial area 75.

In operation, the alternative system is placed upon the rack in a manner similar to that taught in the preferred embodiment of the present invention, the slit also configured to rupture with the application of pressure consistent with the preferred embodiment.

The invention embodiments herein described are done so in detail for exemplary purposes only, and may be subject to many different variations in design, structure, application and operation methodology. Thus, the detailed disclosures therein should be interpreted in an illustrative, exemplary manner, and not in a limited sense.

What is claimed is:

1. A thermoplastic bag having first and second sides and bottom and top ends, said bag comprising:

a bag mouth having opposing ends and a medial area;

a tab emanating from said bag mouth, said tab further comprising a bulbous top portion having a having a sloping top edge having a first upper end extension and second, lower end extension; said tab further including a neck area juxtaposed said bulbous top portion and said bag mouth, said neck having a first, longer neck edge and second, shorter neck edge respectively situated under said first upper and second lower end extensions of said bulbous top portion.

2. The thermoplastic bag of claim 1, wherein said tab emanates from the medial area of said bag mouth.

3. The thermoplastic bag of claim 2, wherein said bulbous top portion of said tab has formed therein a tab slit having first and second ends and a medial area therebetween, said first end formed near said first upper end extension, said slit then sloping into said medial area, said slit then sloping toward said mouth and around generally toward said first upper extension of said bulbous top portion, terminating as said second end of said slit.

* * * * *